US012655992B2

(12) United States Patent
Buschman et al.

(10) Patent No.: US 12,655,992 B2
(45) Date of Patent: Jun. 16, 2026

(54) COOKING APPLIANCE HAVING A FLUE

(71) Applicant: WHIRLPOOL CORPORATION, Benton Harbor, MI (US)

(72) Inventors: Jessica Buschman, St. Joseph, MI (US); Timothy Patrick VanAntwerp, St. Joseph, MI (US); James R. Chisholm, Libertyville, IL (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 18/426,727

(22) Filed: Jan. 30, 2024

(65) Prior Publication Data

US 2024/0167696 A1 May 23, 2024

Related U.S. Application Data

(63) Continuation of application No. 17/099,909, filed on Nov. 17, 2020, now Pat. No. 11,933,501.

(51) Int. Cl.
*F24C 15/20* (2006.01)

(52) U.S. Cl.
CPC ..... *F24C 15/2007* (2013.01)

(58) Field of Classification Search
None
See application file for complete search history.

(56) References Cited

U.S. PATENT DOCUMENTS

| | | | | |
|---|---|---|---|---|
| 1,403,814 | A * | 1/1922 | O'Dowd | F24C 3/08 126/39 K |
| 2,259,639 | A | 10/1941 | Hennessy | |
| 2,264,657 | A | 12/1941 | Brumbaugh | |
| 2,350,293 | A * | 5/1944 | Stanchfield | F24C 15/02 126/21 R |
| 2,743,719 | A | 5/1956 | Reeves | |
| 3,480,000 | A | 11/1969 | Torrey et al. | |
| 4,021,642 | A | 5/1977 | Fields, Jr. | |
| 4,430,541 | A | 2/1984 | Day, Jr. | |
| 6,761,159 | B1 | 7/2004 | Barnes et al. | |
| 10,156,366 | B2 | 12/2018 | Braden et al. | |
| 10,408,467 | B2 | 9/2019 | Chadwick et al. | |
| 2003/0037780 | A1 * | 2/2003 | Wiersma | F24C 3/087 126/21 R |

(Continued)

FOREIGN PATENT DOCUMENTS

| | | | |
|---|---|---|---|
| EP | 3502570 | A1 | 6/2019 |
| GB | 2296089 | A | 6/1996 |

(Continued)

*Primary Examiner* — Jason Lau
(74) *Attorney, Agent, or Firm* — Price Heneveld LLP

(57) ABSTRACT

A cooking appliance includes a housing with a cooktop thereon. An oven is defined within the housing and is accessible via a door. A console extends upward from the cooktop and includes a front side that has a user interface and a rear side that is opposite the front side. A flue is configured to convey air from the oven cavity to the rear side of the console. A flue cover is coupled to the rear side of the console. The flue cover defines a chamber that has open upper and lower ends. The air conveyed from the oven cavity by the flue is configured to flow out of the rear side of the console into the chamber between the upper and lower ends.

19 Claims, 4 Drawing Sheets

(56) References Cited

U.S. PATENT DOCUMENTS

| | | | | |
|---|---|---|---|---|
| 2004/0177842 | A1* | 9/2004 | Larsen | F24C 3/087 126/41 R |
| 2011/0048248 | A1 | 3/2011 | Manson et al. | |
| 2014/0345596 | A1 | 11/2014 | Daughtridge, Jr. et al. | |
| 2016/0178218 | A1* | 6/2016 | Kulemin | F24C 15/2007 126/21 R |
| 2019/0212014 | A1* | 7/2019 | Chadwick | F24C 15/02 |
| 2020/0025390 | A1 | 1/2020 | Lee | |
| 2020/0284434 | A1* | 9/2020 | Therrien | F24B 1/182 |

FOREIGN PATENT DOCUMENTS

| | | | | |
|---|---|---|---|---|
| JP | S60164132 | A | 8/1985 | |
| KR | 200371476 | Y1 | 1/2005 | |
| KR | 100487310 | B1 | 5/2005 | |
| KR | 20100086753 | A * | 8/2010 | B01D 53/885 |

* cited by examiner

COOKING APPLIANCE HAVING A FLUE

CROSS-REFERENCE TO RELATED APPLICATION

This application is a continuation of U.S. application Ser. No. 17/099,909, now U.S. Pat. No. 11,933,501 B2, filed on Nov. 17, 2020, the entire contents of which are hereby incorporated herein by reference.

BACKGROUND OF THE DISCLOSURE

The present disclosure generally relates to a cooking appliance and, more specifically, to a cooking appliance that includes a flue extending from an oven cavity out of a rear side of a console and into a chamber defined by a flue cover.

SUMMARY OF THE DISCLOSURE

According to one aspect of the present disclosure, a cooking appliance includes a housing having a cooktop thereon. An oven is defined within the housing and is accessible via a door. A console extends upward from the cooktop and includes a user interface. A back panel includes an interior surface that faces a front side of the console and an exterior surface that forms at least a portion of a rear side of the console opposite the front side of the console. A flue is configured to convey air from the oven cavity to the rear side of the console. A flue cover is coupled to the exterior surface of the back panel on the rear side of the console. The flue cover defines a chamber between the exterior surface of the back panel and the flue cover. The chamber includes open upper and lower ends. The air conveyed from the oven cavity by the flue is configured to flow out of the rear side of the console and into the chamber between the upper and lower ends.

According to another aspect of the present disclosure, a cooking appliance includes a housing with a cooktop thereon. An oven is defined within the housing and is accessible via a door. A console extends upward from the cooktop and includes a front side that has a user interface and a rear side that is opposite the front side. A flue is configured to convey air from the oven cavity to the rear side of the console. A flue cover is coupled to the rear side of the console. The flue cover defines a chamber that has open upper and lower ends. The air conveyed from the oven cavity by the flue is configured to flow out of the rear side of the console into the chamber between the upper and lower ends.

According to yet another aspect of the present disclosure, a cooking appliance includes an oven cavity, a cooktop positioned above the oven cavity, and a console extending above the cooktop, such that the cooktop is positioned generally between the console and the oven cavity. A flue extends from the oven cavity to a rear side of the console. A flue cover is coupled to the rear side of the console and defines a chamber into which air conveyed by the flue from the oven cavity is expelled.

These and other features, advantages, and objects of the present disclosure will be further understood and appreciated by those skilled in the art by reference to the following specification, claims, and appended drawings.

Figure 1:
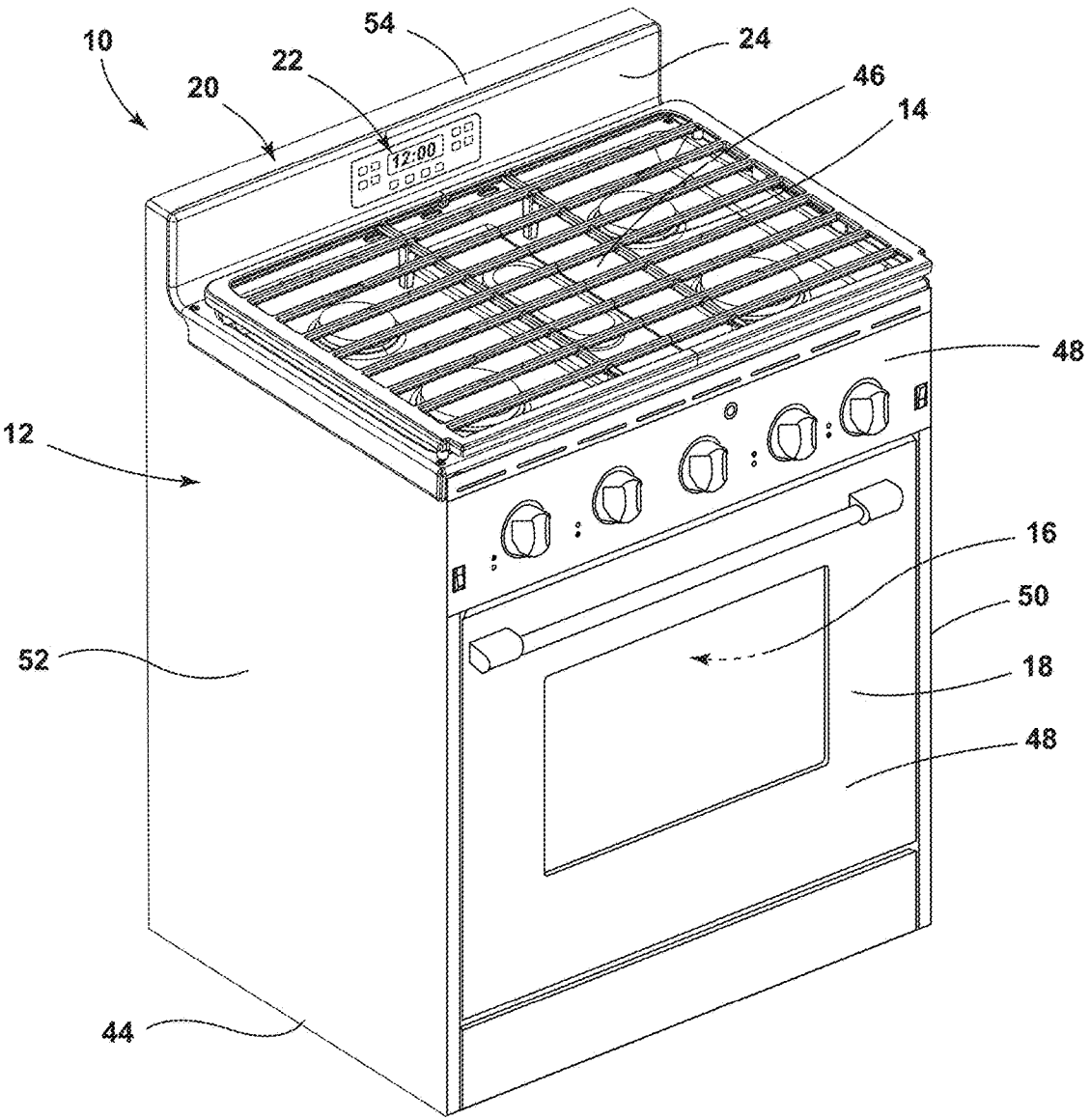
FIG. 1 is a top perspective view of a cooking appliance that includes a cooktop and an oven cavity concealed by a door.

The components in the figures are not necessarily to scale, emphasis instead being placed upon illustrating the principles described herein.

DETAILED DESCRIPTION

The present illustrated embodiments reside primarily in combinations of apparatus components related to a cooking appliance having a flue. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

Figure 2:
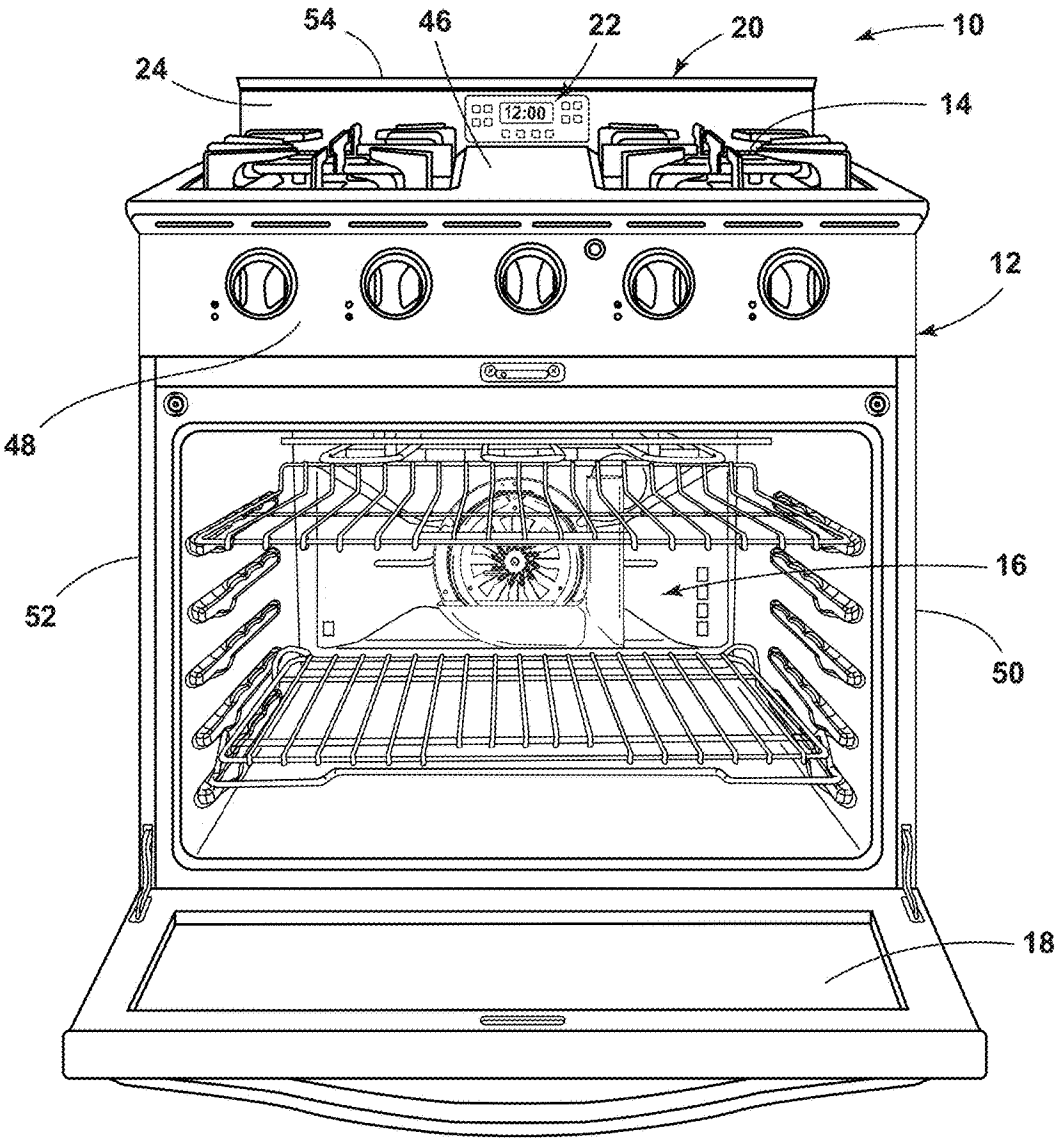
FIG. 2 is a front perspective view of a cooking appliance that includes a cooktop and a door in an open position revealing an oven cavity.

For purposes of description herein, the terms "upper," "lower," "right," "left," "rear," "front," "vertical," "horizontal," and derivatives thereof shall relate to the disclosure as oriented in FIG. 2. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that an apparatus that comprises a list of elements does not include only those elements but may include other elements not expressly listed or inherent to such apparatus. An element proceeded by "comprises a . . . " does not, without more constraints, preclude the existence of additional identical elements in the apparatus that comprises the element.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

Referring to FIGS. 1-4, reference 10 generally designates a cooking appliance 10. The cooking appliance 10 includes a housing 12 with a cooktop 14 thereon. An oven cavity 16 is defined within the housing 12 and is accessible via a door 18. A console 20 extends upward from the cooktop 14 and includes a user interface 22 positioned on a front side 24 of the console 20. A back panel 26 has an interior surface 28 that faces the front side 24 of the console 20 and an exterior surface 30 that forms at least a portion of a rear side 32 of the console 20 opposite the front side 24 of the console 20. A flue 34 is configured to convey air from the oven cavity 16 to the rear side 32 of the console 20. A flue cover 36 is coupled to the exterior surface 30 of the back panel 26 on the rear side 32 of the console 20. The flue cover 36 defines a chamber 38 between the exterior surface 30 of the back panel 26 and the flue cover 36. The chamber 38 includes open upper and lower ends 40, 42. The air conveyed from the oven cavity 16 by the flue 34 is configured to flow out of the rear side 32 of the console 20 into the chamber 38 between the upper and lower ends 40, 42.

Figure 3:
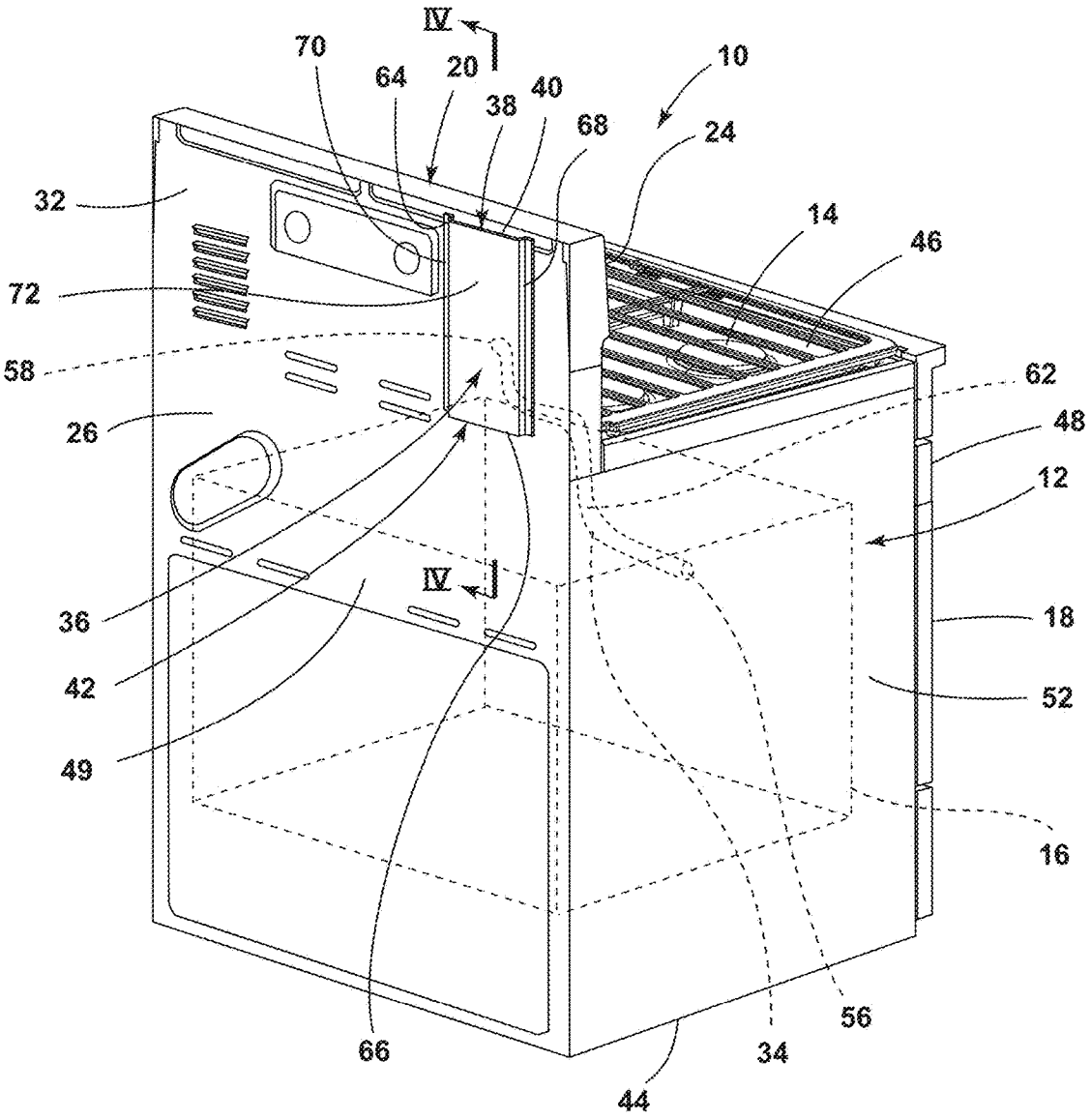
FIG. 3 is a rear perspective view of a cooking appliance that illustrates a flue extending from an inlet in communication with an oven cavity to an outlet that is proximate to a rear side of a console and disposed within a chamber defined by a flue cover.

Referring now to FIGS. 1-3, the cooking appliance 10 is illustrated. The cooking appliance 10 includes the housing 12. The housing 12 includes a bottom 44, a top 46 opposite the bottom 44, a front 48 positioned between the top 46 and the bottom 44, a back 49 between the top 46 and the bottom 44 opposite the front 48, a right side 50 extending between the top 46 and the bottom 44 and the front 48 and the back 49, and a left side 52 extending between the top 46 and the bottom 44 and the front 48 and the back 49 opposite the right side 50. The bottom 44 of the housing 12 may rest on and/or face a floor upon which the cooking appliance 10 resides. The top 46 may include the cooktop 14, as illustrated in FIGS. 1 and 2. The back 49 of the housing 12 may generally face a wall next to which the cooking appliance 10 resides in a typical use position, such that the back 49 of the housing 12 is generally concealed from the view of a user of the cooking appliance 10. The front 48 of the housing 12 may include the door 18, which is operable between a closed position, as illustrated in FIG. 1, and an open position, as illustrated in FIG. 2. The door 18 restricts access to the oven cavity 16 defined within the housing 12 in the closed position, and provides access to the oven cavity 16 defined within the housing 12 in the open position. It is contemplated that the cooking appliance 10 may heat the oven cavity 16 and/or the cooktop 14 via gas burners and/or via electric heating elements.

Figure 4:
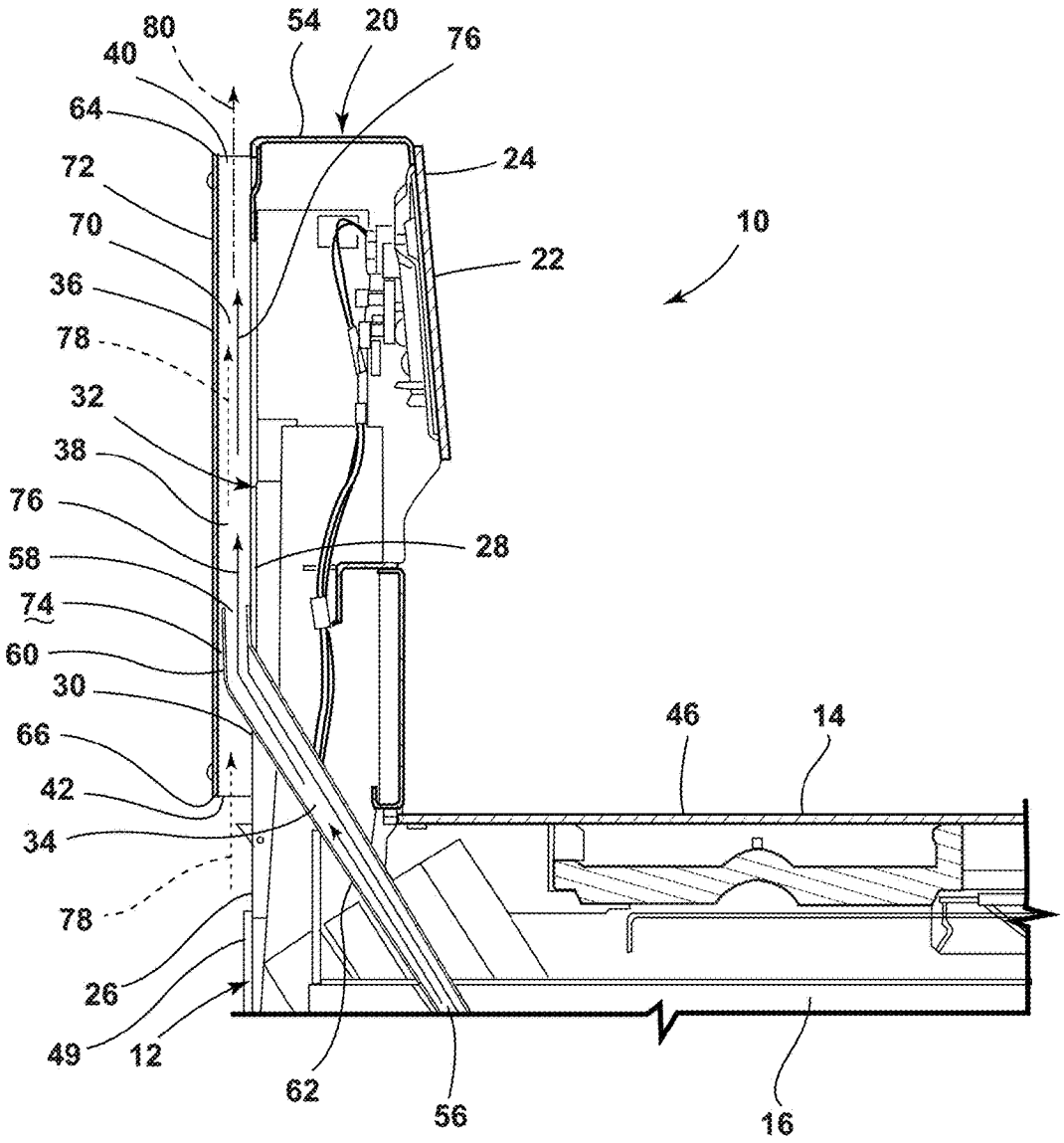
FIG. 4 is a cross-sectional view taken at line IV-IV of FIG. 3, illustrating a flue of the cooking appliance extending from an oven cavity to a chamber defined by a flue cover and a rear side of a console.

The cooking appliance 10 includes the console 20. As illustrated in FIGS. 1, 2, and 4, the console 20 extends upward from the cooktop 14 proximate to the back 49 of the housing 12. As illustrated in FIG. 4, the console 20 extends above the cooktop 14, such that the cooktop 14 is positioned generally between the console 20 and the oven cavity 16 defined within the housing 12. The console 20 includes the front side 24, the rear side 32 opposite the front side 24, and a top side 54 that is positioned between the front and rear sides 24, 32 of the console 20. The top side 54 of the console 20 faces generally upward away from the cooktop 14 of the cooking appliance 10. In some implementations, the console 20 may include the user interface 22. For example, as illustrated in FIGS. 1, 2, and 4, the user interface 22 is positioned on the front side 24 of the console 20. The user interface 22 may include at least one of a variety of input features configured to receive an input from a user for controlling the cooking appliance 10 (e.g., touchscreen, buttons, knobs, switches, etc.). As illustrated in FIG. 4, the rear side 32 of the console 20 is positioned opposite the front side 24 of the console 20. In some examples, the rear side 32 of the console 20 is flush with the back 49 of the housing 12.

Referring now to FIGS. 3 and 4, the cooking appliance 10 may include the back panel 26. The back panel 26 may extend across at least a portion of the rear side 32 of the console 20. In some implementations, the back panel 26 may extend beyond the rear side 32 of the console 20 along the back 49 of the housing 12 of the cooking appliance 10. For example, as illustrated in FIG. 3, the back panel 26 extends from the top side 54 of the console 20 downward along the rear side 32 of the console 20 and the back 49 of the housing 12 of the cooking appliance 10. As illustrated in FIG. 4, the back panel 26 includes the interior surface 28 and the exterior surface 30 opposite the interior surface 28. The interior surface 28 of the back panel 26 faces the front side 24 of the console 20. As illustrated in FIG. 4, the interior surface 28 of the back panel 26 faces the user interface 22 coupled to the front side 24 of the console 20. In some implementations, the exterior surface 30 of the back panel 26 forms at least a portion of the rear side 32 of the console 20. For example, as illustrated in FIGS. 3 and 4, the exterior surface 30 of the back panel 26 forms the rear side 32 of the console 20 and the back 49 of the housing 12 of the cooking appliance 10. In various examples, the back panel 26 may be formed of metal, such as aluminum. It is contemplated that the back panel 26 may be formed of one or more of a variety of materials.

Referring now to FIGS. 3 and 4, the cooking appliance 10 includes the flue 34. The flue 34 is configured to convey air from the oven cavity 16 to the rear side 32 of the console 20. As illustrated in FIG. 4, the flue 34 extends from an inlet 56 that is in communication with the oven cavity 16 through a portion of the housing 12 above the oven cavity 16, into the console 20 between the front and rear sides 24, 32 of the console 20, and to an outlet 58 positioned proximate to the rear side 32 of the console 20. In some examples, the outlet 58 of the flue 34 may be flush with and/or defined by the rear side 32 of the console 20. For example, the outlet 58 may be an aperture defined by the back panel 26, such that air is conveyed into the inlet 56 of the flue 34 from the oven cavity 16 and out of the outlet 58 by passing through the aperture in the back panel 26.

In some implementations, the flue 34 may extend out of the rear side 32 of the console 20, such that the outlet 58 of the flue 34 is positioned externally of the console 20. For example, as illustrated in FIG. 4, the flue 34 includes a chimney portion 60 that extends outward from the rear side 32 of the console 20 to the outlet 58 of the flue 34. In the embodiment illustrated in FIG. 4, the flue 34 comprises a pipe 62 that extends from the inlet 56 to the outlet 58, and the pipe 62 extends out of the rear side 32 of the console 20 through an aperture defined by the back panel 26. In some examples, the flue 34 extends out of the rear side 32 of the console 20 without extending through the back panel 26. For example, the flue 34 may extend around a peripheral edge of the back panel 26, in some implementations. It is contemplated that the flue 34 may be a variety of types of flues and may be formed of one or more components, in various implementations. In the embodiment illustrated in FIG. 4, the chimney portion 60 of the flue 34 is the portion of the pipe 62 that protrudes through the aperture in the back panel 26 out of the rear side 32 of the console 20.

Referring still to FIGS. 3 and 4, the cooking appliance 10 includes the flue cover 36. The flue cover 36 is coupled to the rear side 32 of the console 20 and defines the chamber 38. In some implementations, the chamber 38 is defined by the flue cover 36 together with the rear side 32 of the console 20. In the embodiment illustrated in FIG. 3, the flue cover 36 is coupled to the exterior surface 30 of the back panel 26 which forms the rear side 32 of the console 20, and the chamber 38 is defined by the exterior surface 30 of the back panel 26 and the flue cover 36.

As illustrated in FIG. 4, the chamber 38 defined by the flue cover 36 includes open upper and lower ends 40, 42. In other words, the chamber 38 is in communication with an external environment of the chamber 38 at the upper end 40 of the chamber 38 and the lower end 42 of the chamber 38. The upper end 40 of the chamber 38 is proximate to and/or defined by an upper edge 64 of the flue cover 36, and the lower end 42 of the chamber 38 is proximate to and/or defined by a lower edge 66 of the flue cover 36.

In some implementations, the flue cover 36 includes a first side wall 68 that extends outward from the rear side 32 of the console 20, a second side wall 70 that extends outward from the rear side 32 of the console 20, and a rear wall 72 that extends between the first and second side walls 68, 70. For example, as illustrated in FIG. 3, the flue cover 36 includes the first side wall 68, which is coupled to the exterior surface 30 of the back panel 26 and extends outward therefrom, the second side wall 70, which is coupled to the exterior surface 30 of the back panel 26 and extends outward therefrom, and the rear wall 72 that is spaced apart from the exterior surface 30 of the back panel 26 and extends between the first and second side walls 68, 70. In the illustrated embodiment, the rear wall 72 of the flue cover 36 extends from the first side wall 68 to the second side wall 70, such that the rear wall 72 is substantially planar. In some examples, the rear wall 72 may be substantially planar and parallel to a plane of the rear side 32 of the console 20. Shaping the rear wall 72 of the flue cover 36 in this way may allow the rear wall 72 of the flue cover 36 to lie flat against a wall that the back 49 of the housing 12 of the cooking appliance 10 faces.

In the embodiments illustrated in FIGS. 3 and 4, the chamber 38 is disposed between the upper and lower edges 64, 66 of the flue cover 36 and is defined by the back panel 26, the first and second side walls 68, 70 of the flue cover 36, and the rear wall 72 of the flue cover 36. In some implementations, the chamber 38 may extend from the exterior surface 30 of the back panel 26 to the flue cover 36 in a direction that is perpendicular to a plane of the rear side 32 of the console 20 a distance in a range of about 6 millimeters (hereinafter "mm") to about 15 mm. In some examples, the chamber 38 extends from the exterior surface 30 of the back panel 26 to the rear wall 72 of the flue cover 36 in a direction perpendicular to the plane of the rear wall 72 of the flue cover 36 a distance in a range of about 6 mm to about 15 mm. In other words, the chamber 38 may have a depth in a range of about 6 mm to about 15 mm. The chamber 38 extends from the first side wall 68 to the second side wall 70 a width of less than about 140 mm, in some examples. In other words, the chamber 38 may have a width of less than about 140 mm. As illustrated in FIGS. 3 and 4, the upper edge 64 of the flue cover 36 is positioned below the top side 54 of the console 20, such that the top side 54 of the console 20 is a first distance from the lower edge 66 of the flue cover 36 and the upper edge 64 of the flue cover 36 is a second distance from the lower edge 66 of the flue cover 36, wherein the first distance is greater than the second distance. In other words, the flue cover 36 extends upward from the lower edge 66 along the rear side 32 of the console 20 and terminates at the upper edge 64 before extending above the top side 54 of the console 20.

Referring now to FIG. 4, in some implementations, the chimney portion 60 of the flue 34 that extends outward from the rear side 32 of the console 20 is positioned within the chamber 38 defined by the flue cover 36. In other words, the chimney portion 60 protrudes into the chamber 38 between the upper and lower ends 40, 42 of the chamber 38. As illustrated in FIG. 4, the chimney portion 60 of the flue 34 may be in a spaced relationship with the flue cover 36, such that a gap 74 exists between the chimney portion 60 and the flue cover 36. This gap 74 is configured to prevent the chimney portion 60 of the flue 34 from contacting the flue cover 36, which may aid in preventing the flue cover 36 from overheating due to heat transferred from the flue 34. In some implementations, the chimney portion 60 of the flue 34 disposed within the chamber 38 extends from the rear side 32 of the console 20 into the chamber 38 in a direction that is perpendicular to a plane of the rear side 32 of the console 20 a distance in a range of about 5 mm to about 10 mm. In other words, the chimney portion 60 may extend from the rear side 32 of the console 20 into the chamber 38 in a depth direction of the chamber 38 a distance in a range of about 5 mm to about 10 mm. In some implementations, the chimney portion 60 of the flue 34 may extend in a width direction of the chamber 38 a distance that is less than 100 mm.

In some implementations, it is critical that the depth of the chamber 38 is a distance in a range of about 6 mm to about 15 mm and that the chimney portion 60 of the flue 34 protrudes into the chamber 38 in a depth direction a distance in a range of about 5 mm to about 10 mm. In a given embodiment of the cooking appliance 10, the dimensions of the chamber 38 and the chimney portion 60 may be tailored within these ranges to ensure that the gap 74 exists between the chimney portion 60 and the flue cover 36. For example, in one embodiment, the chamber 38 may have a depth of 6 mm, and the chimney portion 60 may protrude into the chamber 38 in the depth direction 5 mm, such that a gap 74 of 1 mm exists between the chimney portion 60 and the flue cover 36. In another embodiment, the chamber 38 may have a depth of 15 mm, and the chimney portion 60 may protrude into the chamber 38 in the depth direction 10 mm, such that a 5 mm gap 74 exists between the chimney portion 60 and the flue cover 36.

In some implementations, it is critical that the width of the chamber 38 is a distance of less than about 140 mm and that the dimensions of the chimney portion 60 of the flue 34 in the width direction is a distance of less than about 100 mm. In a given embodiment of the cooking appliance 10 the dimensions of the chamber 38 and the chimney portion 60 may be tailored within these ranges to ensure that a gap 74 exists between the chimney portion 60 and the first and second side walls 68, 70 of the flue cover 36. For example, in one embodiment, the chamber 38 may have a width of about 140 mm, and the chimney portion 60 may extend in a width direction of the chamber 38 a distance of about 100 mm. In another example, the chamber 38 may have a width of about 100 mm, and the chimney portion 60 may extend in a width direction of the chamber 38 a distance of about 60 mm. Various dimensions of the chamber 38 and the chimney portion 60 of the flue 34 that would provide the gap 74 between the chimney portion 60 and the flue cover 36 are contemplated.

In operation of the cooking appliance 10, relatively warm air 76 from the oven cavity 16 enters the inlet 56 of the flue 34 and is conveyed by the flue 34 out of the rear side 32 of the console 20 into the chamber 38 defined by the flue cover 36 between the open upper and lower ends 40, 42 of the chamber 38. As the relatively warm air 76 is expelled into the chamber 38, relatively cool air 78 is drawn into the lower end 42 of the chamber 38 via convection. The relatively cool air 78 mixes with the relatively warm air 76 within the chamber 38 to form mixed air 80 that exits the open upper end 40 of the chamber 38 at a temperature that is cooler than the relatively warm air 76 initially expelled into the chamber 38.

The cooking appliance as described in the present disclosure may provide a variety of advantages. First, the flue 34 extending from the oven cavity 16 to the rear side 32 of the console 20 may conceal the outlet 58 of the flue 34 from users operating the cooking appliance 10, which may contribute to the aesthetics of the cooking appliance 10. Second, the flue cover 36 extending over the chimney portion 60 of the flue 34 may prevent the chimney portion 60 of the flue 34 from contacting the wall adjacent to the back 49 of the housing 12 of the cooking appliance 10, which may provide a thermal barrier between the wall and the chimney portion 60. Third, the gap 74 between the chimney portion 60 of the flue 34 and the flue cover 36 may insulate the flue cover 36 from the chimney portion 60 to prevent overheating of the flue cover 36. Fourth, the flue cover 36 having the open upper end 40 and the open lower end 42 may allow for relatively cool air 78 to be drawn into the chamber 38 via convection, and the relatively cool air 78 may mix with relatively warm air 76 being expelled into the chamber 38 from the flue 34, such that the mixed air 80 exiting the top of the chamber 38 is not overly hot.

According to an aspect of the disclosure, a cooking appliance includes a housing having a cooktop thereon, an oven cavity defined within the housing and accessible via a door, a console extending upward from the cooktop and including a user interface positioned on a front side of the console, a back panel having an interior surface that faces the front side of the console and an exterior surface that forms at least a portion of a rear side of the console opposite the front side of the console, a flue configured to convey air from the oven cavity to the rear side of the console, and a flue cover coupled to the exterior surface of the back panel on the rear side of the console and defining a chamber between the exterior surface of the back panel and the flue cover. The chamber includes open upper and lower ends. The air conveyed from the oven cavity by the flue is configured to flow out of the rear side of the console into the chamber between the upper and lower ends.

According to another aspect, the flue includes a chimney portion that protrudes into the chamber.

According to yet another aspect, the chimney portion within the chamber extends from the rear side of the console into the chamber in a direction perpendicular to a plane of the rear side of the console a distance in a range of about 5 mm to about 10 mm.

According to another aspect, the chamber extends from the exterior surface of the back panel to the flue cover in a direction perpendicular to a plane of the rear side of the console a distance in a range of about 6 mm to about 15 mm.

According to yet another aspect, the chimney portion is in a spaced relationship with the flue cover, such that a gap exists between the chimney portion and the flue cover.

According to another aspect, the console includes a top side positioned between the front and rear sides of the console, and the flue cover includes an upper edge proximate to the upper end of the chamber and a lower edge proximate to the lower end of the chamber. The upper edge of the flue cover is positioned below the top side of the console, such that the top side of the console is a first distance from the lower edge of the flue cover, and the upper edge of the flue cover is a second distance from the lower edge of the flue cover, wherein the first distance is greater than the second distance.

According to yet another aspect, the flue cover includes a first side wall coupled to the exterior surface of the back panel and extending outward therefrom, a second side wall coupled to the exterior surface of the back panel and extending outward therefrom, and a rear wall that extends between the first and second side walls.

According to another aspect, the chamber extends from the first side wall to the second side wall a width of less than about 140 mm.

According to still another aspect, the rear wall is substantially planar and parallel to a plane of the rear side of the console.

According to another aspect of the present disclosure, a cooking appliance includes a housing including a cooktop thereon, an oven cavity defined within the housing and accessible via a door, a console extending upward from the cooktop and having a front side that includes a user interface and a rear side opposite the front side, a flue configured to convey air from the oven cavity to the rear side of the console, and a flue cover coupled to the rear side of the console and defining a chamber having open upper and lower ends. The air conveyed from the oven cavity by the flue is configured to flow out of the rear side of the console into the chamber between the upper and lower ends.

According to another aspect, the chamber is defined by the flue cover and the rear side of the console.

According to yet another aspect, the rear side of the console includes a back panel having an interior surface and an exterior surface opposite the interior surface. The interior surface faces the front side of the console, and the flue cover is coupled to the exterior surface.

According to still another aspect, the back panel extends downward from the rear side of the console along a back of the housing.

According to another aspect, the flue includes a chimney portion that protrudes into the chamber.

According to yet another aspect, the chimney portion is in a spaced relationship with the flue cover, such that a gap exists between the chimney portion and the flue cover.

According to another aspect of the present disclosure, a cooking appliance includes an oven cavity, a cooktop positioned above the oven cavity, a console extending above the cooktop, such that the cooktop is positioned generally between the console and the oven cavity, a flue extending from the oven cavity to a rear side of the console, and a flue cover coupled to the rear side of the console and defining a chamber into which air conveyed by the flue from the oven cavity is expelled.

According to yet another aspect, the chamber defined by the flue cover includes an open lower end and an open upper end. Relatively warm air is expelled into the chamber between the open upper end and the open lower end, relatively cool air is drawn into the open lower end via convection, and a mixture of the relatively warm air and the relatively cool air exits the open upper end.

According to still another aspect, the flue includes a chimney portion that protrudes into the chamber.

According to another aspect, the chimney portion is in a spaced relationship with the flue cover, such that a gap exists between the chimney portion and the flue cover.

According to yet another aspect, the chamber is defined by the flue cover and the rear side of the console.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

What is claimed is:

1. A cooking appliance, comprising:

a housing including a cooktop thereon and having a front side, a back side, a top side and a bottom side;

an oven cavity defined within the housing, accessible via a door, and having a plurality of baking racks disposed therein;

a console extending upward from the cooktop and having a front side on which a user interface is positioned, a rear side opposite the front side, and a top side that extends between the front and rear sides, wherein the back of the housing and the rear side of the console cooperate to form a back side of the cooking appliance that faces rearward and that extends from the top side of the console to the bottom of the housing;

a flue including an inlet at the oven cavity configured to convey air from the inlet to an outlet at the back side of the housing, the outlet disposed above the inlet such that the flue traverses a portion of the housing above the oven cavity and extends into the console; and a flue cover coupled to the back side of the cooking appliance and defining a chamber between the back side of the cooking appliance and the flue cover, wherein the chamber includes open upper and lower ends, and wherein the flue cover is positioned, such that the air conveyed from the oven cavity by the flue flows out of the back side of the cooking appliance into the chamber, entering the chamber at a portion of the chamber that is between the open upper and lower ends and is in a spaced relationship with the open lower end.

2. The cooking appliance of claim 1, wherein the flue includes a chimney portion that protrudes into the chamber and is disposed between the flue cover and the back side of the cooking appliance.

3. The cooking appliance of claim 2, wherein the chimney portion within the chamber extends from the rear side of the console into the chamber in a direction perpendicular to a plane of the rear side of the console a distance in a range of about 5 mm to about 10 mm.

4. The cooking appliance of claim 1, wherein the chamber extends from the back side of the cooking appliance to the flue cover in a direction perpendicular to a plane of the back side of the cooking appliance a distance in a range of about 6 mm to about 15 mm.

5. The cooking appliance of claim 2, wherein the chimney portion is in a spaced relationship with the flue cover, such that a gap exists between the chimney portion and the flue cover.

6. The cooking appliance of claim 1, wherein the flue cover includes an upper edge proximate to the upper end of the chamber and a lower edge proximate to the lower end of the chamber, wherein the upper edge of the flue cover is positioned below the top side of the console, such that the top side of the console is a first distance from the lower edge of the flue cover, and the upper edge of the flue cover is a second distance from the lower edge of the flue cover, and wherein the first distance is greater than the second distance.

7. The cooking appliance of claim 1, wherein the flue cover includes a first side wall coupled to the back side of the cooking appliance and extending outward therefrom, a second side wall coupled to the back side of the cooking appliance and extending outward therefrom, and a rear wall that extends between the first and second side walls.

8. The cooking appliance of claim 7, wherein the chamber extends from the first side wall to the second side wall a width of less than about 140 mm.

9. The cooking appliance of claim 7, wherein the rear wall is substantially planar and parallel to a plane of the rear side of the console.

10. A cooking appliance, comprising:

a housing having a front side, a back side, a top side and a bottom side;

a cooktop disposed on the top side of the housing;

an oven cavity defined within the housing, accessible via a door, and having a plurality of baking racks disposed therein;

a console extending upward from the cooktop and having a console front side that includes a user interface and a rear side opposite the front side;

a flue including an inlet at the oven cavity configured to convey air from the inlet to an outlet at the rear side of the console, the outlet disposed above the inlet such that the flue traverses a portion of the housing above the oven cavity and extends into the console; and a flue cover coupled to the rear side of the console and defining a chamber having open upper and lower ends, wherein the air conveyed from the oven cavity by the flue is configured to flow out of the rear side of the console into the chamber between the upper and lower ends without first flowing through the open lower end of the chamber, the rear side of the console includes a back panel that extends downward along a back of the housing, and the flue cover is coupled to an exterior surface of the back panel that faces rearward.

11. The cooking appliance of claim 10, wherein the chamber is defined by the flue cover and the rear side of the console.

12. The cooking appliance of claim 10, wherein the back panel includes an interior surface that is opposite the exterior surface and that faces the front side of the console.

13. The cooking appliance of claim 12, wherein the back panel extends from the console to a bottom of the housing.

14. The cooking appliance of claim 10, wherein the flue includes a chimney portion that protrudes into the chamber and is disposed between the flue cover and the back side of the cooking appliance.

15. The cooking appliance of claim 14, wherein the chimney portion is in a spaced relationship with the flue cover, such that a gap exists between the chimney portion and the flue cover.

16. A cooking appliance, comprising:

a housing including a bottom side, a top side, a front side, and a back side opposite the front;

an oven cavity disposed within the housing and having a plurality of baking racks disposed therein;

a cooktop disposed on the housing top side, positioned above the oven cavity;

a console extending above the cooktop, such that the cooktop is positioned generally between the console and the oven cavity;

a flue including an inlet at the oven cavity and an outlet at the back side of the housing, the outlet disposed above the inlet such that the flue traverses a portion of the housing above the oven cavity and extends into the console, wherein the back side faces rearward and extends from a top side of the console to a bottom of a housing of the cooking appliance within which the oven cavity is disposed; and a flue cover coupled to the back side of the cooking appliance and defining a chamber into which air conveyed by the flue from the oven cavity is expelled, wherein the chamber defined by the flue cover includes an open lower end and an open upper end, wherein relatively warm air is expelled into the chamber between the open upper and lower ends without first flowing through the open lower end of the chamber, relatively cool air is drawn into the open lower end via convection, and a mixture of the relatively warm air and the relatively cool air exits the open upper end.

17. The cooking appliance of claim 16, wherein the flue includes a chimney portion that protrudes into the chamber and is disposed between the flue cover and the back side of the cooking appliance.

18. The cooking appliance of claim 17, wherein the chimney portion is in a spaced relationship with the flue cover, such that a gap exists between the chimney portion and the flue cover.

19. The cooking appliance of claim 16, wherein the chamber is defined by the flue cover and a rear side of the console.

* * * * *